US011434108B2

(12) United States Patent
Feistner

(10) Patent No.: US 11,434,108 B2
(45) Date of Patent: Sep. 6, 2022

(54) ENGINE HOIST ATTACHMENT ASSEMBLY

(71) Applicant: Phil Feistner, Buckeye, AZ (US)

(72) Inventor: Phil Feistner, Buckeye, AZ (US)

( * ) Notice: Subject to any disclaimer, the term of this patent is extended or adjusted under 35 U.S.C. 154(b) by 570 days.

(21) Appl. No.: 16/551,936

(22) Filed: Aug. 27, 2019

(65) Prior Publication Data

US 2021/0061618 A1 Mar. 4, 2021

(51) Int. Cl.

| | |
|---|---|
| ***B66C 1/00*** | (2006.01) |
| ***B66C 1/10*** | (2006.01) |
| ***B66C 1/22*** | (2006.01) |
| ***B66C 23/46*** | (2006.01) |
| ***B66C 23/48*** | (2006.01) |

(52) U.S. Cl.

CPC ..... *B66C 1/107* (2013.01); *B66C 1/22* (2013.01); *B66C 23/46* (2013.01); *B66C 23/485* (2013.01); *B66C 2700/0357* (2013.01)

(58) Field of Classification Search

CPC .. B66C 1/107; B66C 1/22; B66C 1/28; B66C 23/46; B66C 23/485; B25J 15/0014

See application file for complete search history.

(56) References Cited

U.S. PATENT DOCUMENTS

| | | | | |
|---|---|---|---|---|
| 2,747,837 A | | 5/1956 | Turner | |
| 4,705,264 A | * | 11/1987 | Hawkins | B66C 23/48 269/47 |
| 5,251,875 A | * | 10/1993 | Craychee | B66C 23/48 254/133 R |
| 5,666,747 A | * | 9/1997 | MacQueen | E01H 5/066 37/231 |
| 5,897,100 A | * | 4/1999 | Napier | B66C 23/485 254/133 R |
| 6,109,593 A | | 8/2000 | Craychee | |
| 6,120,236 A | | 9/2000 | Smith | |
| 6,283,220 B1 | * | 9/2001 | Carter | B62D 1/24 901/1 |
| 6,659,503 B2 | * | 12/2003 | Damron | B62D 21/14 180/41 |
| 7,020,823 B2 | | 7/2006 | Triplett | |
| D713,613 S | | 9/2014 | Miles | |
| 9,452,911 B1 | * | 9/2016 | Tipton | B66C 23/485 |
| 2002/0066215 A1 | * | 6/2002 | Kaczmarski | E02F 3/3627 37/468 |
| 2008/0105638 A1 | | 5/2008 | Crawford | |
| 2014/0110647 A1 | | 4/2014 | Filipovic | |

* cited by examiner

*Primary Examiner* — Emmanuel M Marcelo

(57) ABSTRACT

An engine hoist attachment assembly for hoisting a vehicle component includes a tube, a bar, and a pair of rods. The tube has a first end that is configured to slidably insert a terminus of a boom of an engine hoist to removably couple the tube to the boom. The bar has a back face that is coupled to and extends bidirectionally and perpendicularly from a second end of the tube so that the bar is substantially parallel to a surface upon which the engine hoist is positioned. The pair of rods is coupled to and extends in parallel from a front face of the bar. The rods are configured to position under a vehicle component, positioning a user to utilize the engine hoist to selectively lift and lower the vehicle component.

18 Claims, 5 Drawing Sheets

ENGINE HOIST ATTACHMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to engine hoist accessory assemblies and more particularly pertain to a new engine hoist accessory assembly for hoisting a vehicle component.

BRIEF SUMMARY OF THE INVENTION

An embodiment of the disclosure meets the needs presented above by generally comprising a tube, a bar, and a pair of rods. The tube has a first end that is configured to slidably insert a terminus of a boom of an engine hoist to removably couple the tube to the boom. The bar has a back face that is coupled to and extends bidirectionally and perpendicularly from a second end of the tube so that the bar is substantially parallel to a surface upon which the engine hoist is positioned. The pair of rods is coupled to and extends in parallel from a front face of the bar. The rods are configured to position under a vehicle component, positioning a user to utilize the engine hoist to selectively lift and lower the vehicle component.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
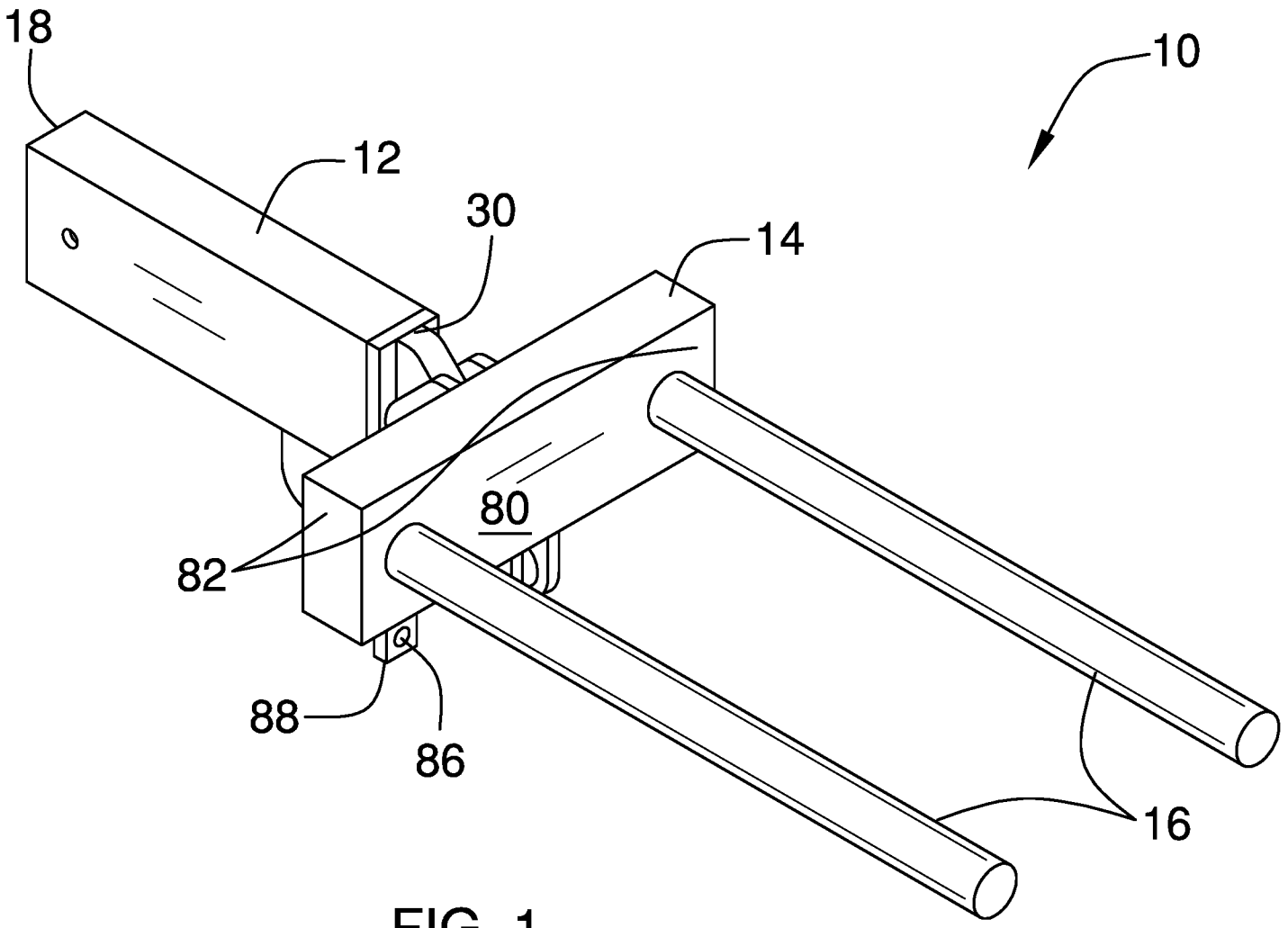
FIG. 1 is a front isometric perspective view of an engine hoist attachment assembly according to an embodiment of the disclosure.
Figure 2:
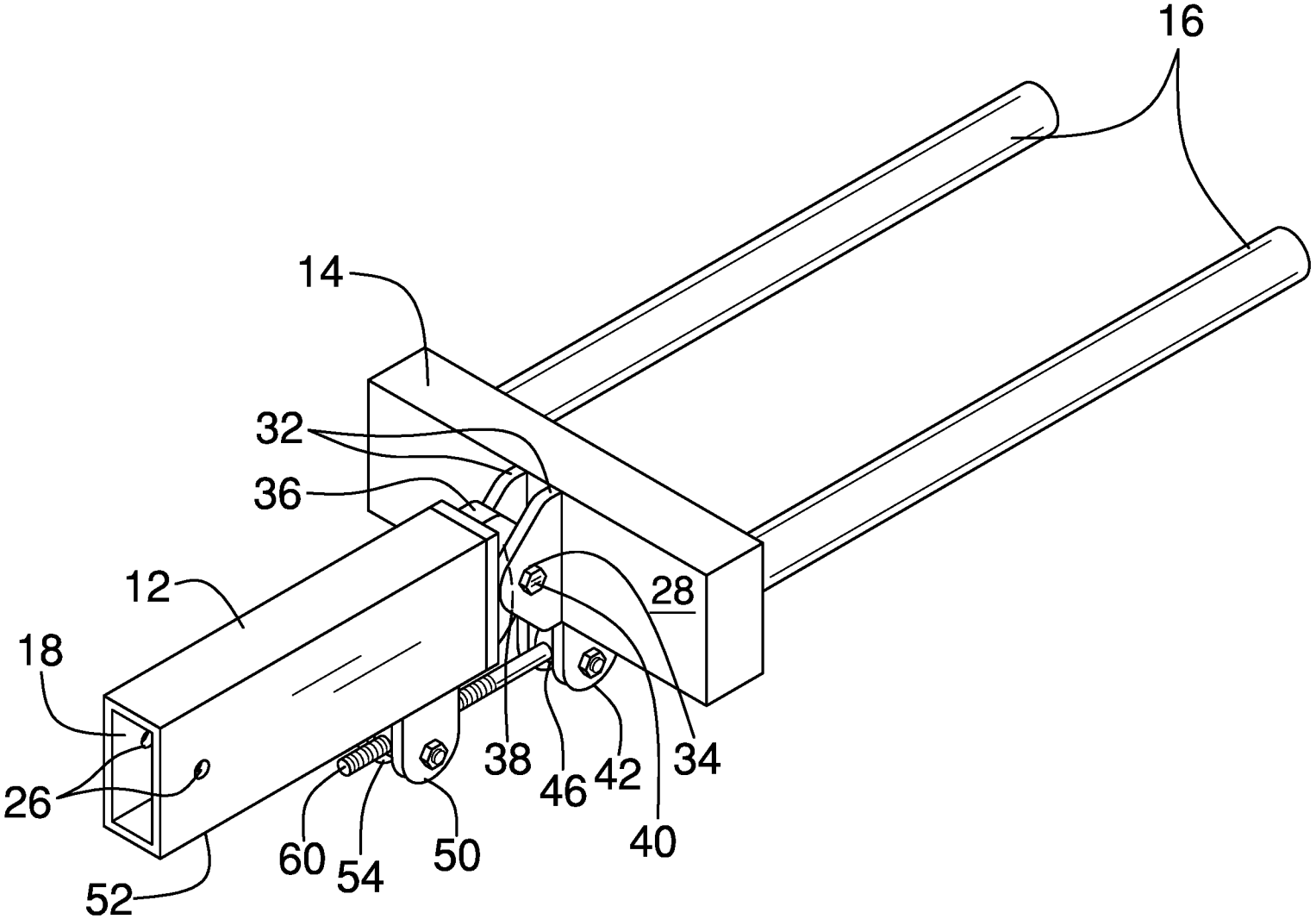
FIG. 2 is a rear isometric perspective view of an embodiment of the disclosure.
Figure 3:
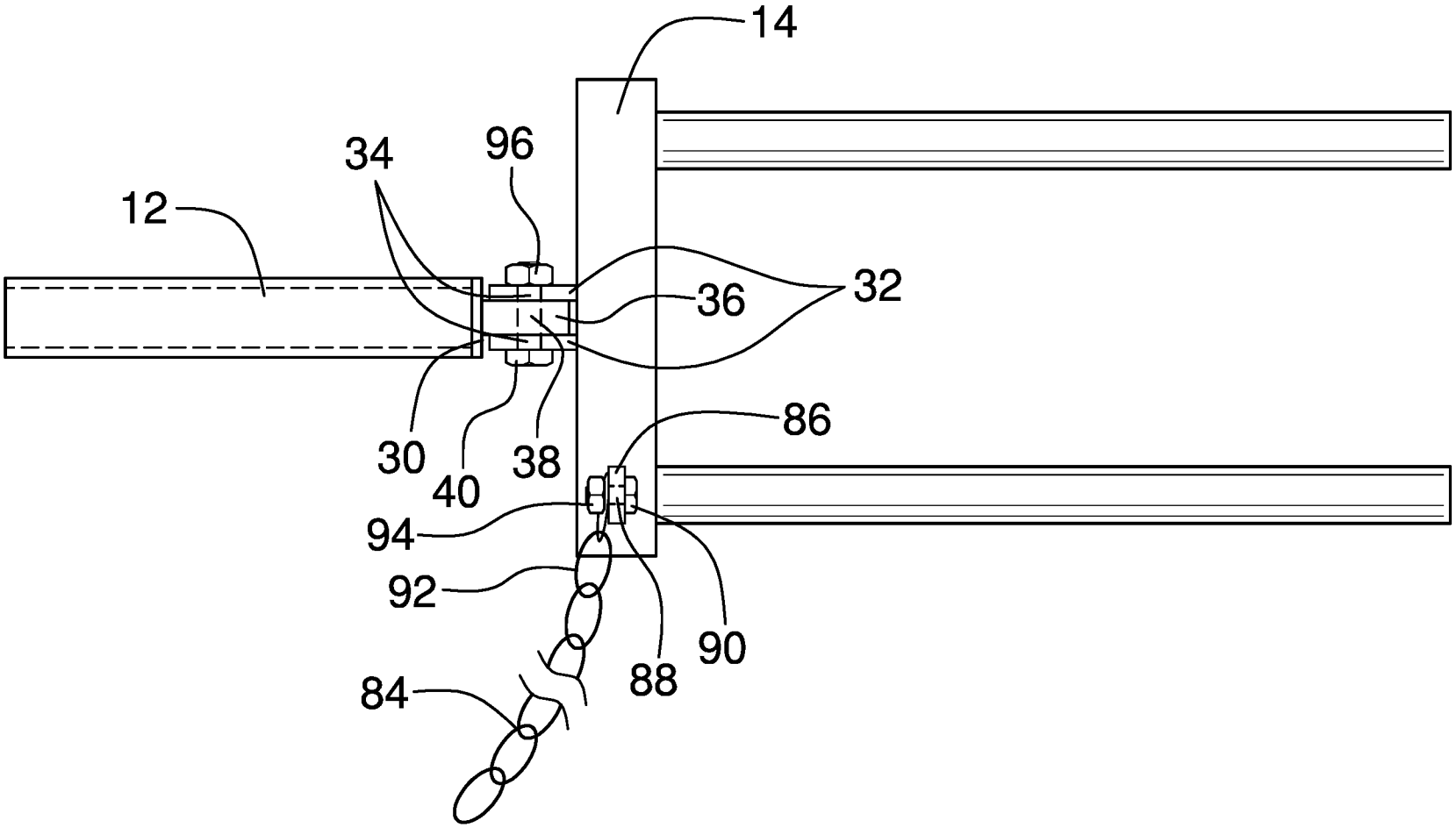
FIG. 3 is a top view of an embodiment of the disclosure.
Figure 4:
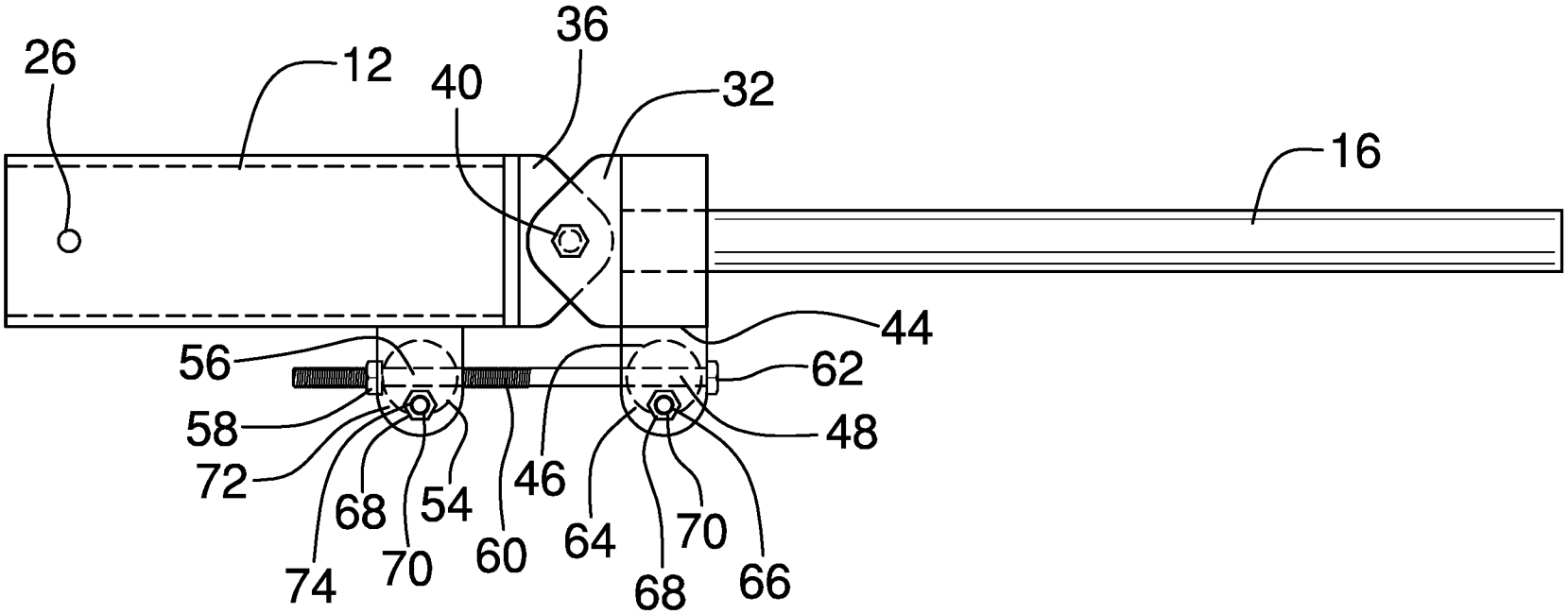
FIG. 4 is a side view of an embodiment of the disclosure.
Figure 5:
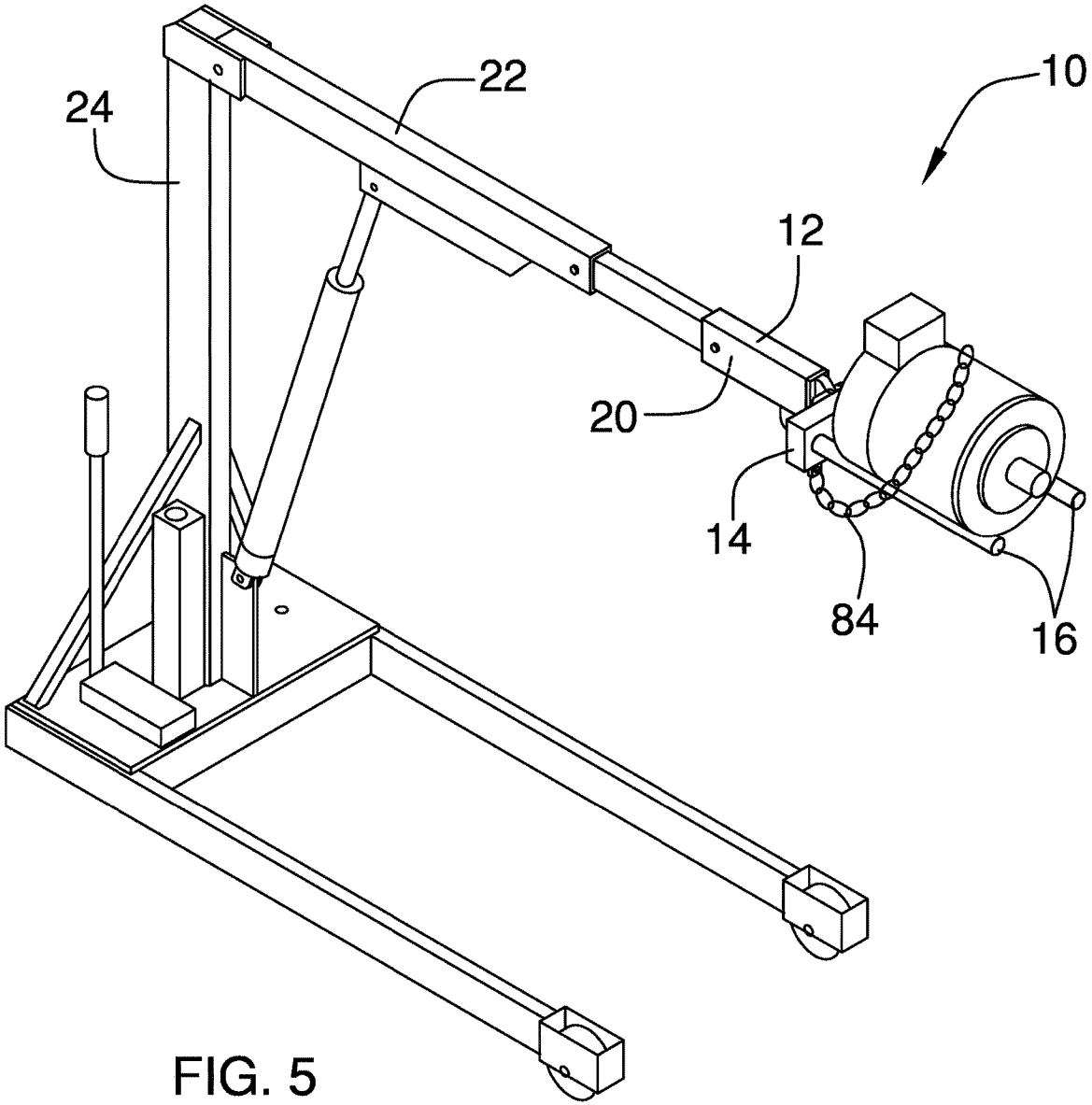
FIG. 5 is an in-use view of an embodiment of the disclosure.

With reference now to the drawings, and in particular to FIGS. 1 through 5 thereof, a new engine hoist accessory assembly embodying the principles and concepts of an embodiment of the disclosure and generally designated by the reference numeral 10 will be described.

As best illustrated in FIGS. 1 through 5, the engine hoist attachment assembly 10 generally comprises a tube 12, a bar 14, and a pair of rods 16. The tube 12 has a first end 18 that is configured to slidably insert a terminus 20 of a boom 22 of an engine hoist 24 to removably couple the tube 12 to the boom 22. The tube 12 is rectangularly shaped when viewed from the first end 18.

A pair of coupling holes 26 is positioned through the tube 12 proximate to the first end 18. The coupling holes 26 are opposingly positioned on the tube 12 and thus are configured to align with a coupling channel that is positioned through the boom 22. The pair of coupling holes 26 and the coupling channel are configured to insert a coupling pin to removably couple the tube 12 to the boom 22.

The bar 14 has a back face 28 that is coupled to and extends bidirectionally and perpendicularly from a second end 30 of the tube 12 so that the bar 14 is substantially parallel to a surface upon which the engine hoist 24 is positioned. The bar 14 is hingedly coupled to the tube 12 so that the bar 14 is positioned to be partially hinged relative to the bar 14 while remaining perpendicular to the tube 12. The bar 14 is substantially rectangularly box shaped and is tubular.

A pair of hinge tabs 32 is coupled to and extends from the back face 28 the bar 14. Each of a pair of hinge holes 34 is positioned through a respective hinge tab 32. A protrusion 36 is coupled to and extends from the second end 30 of the tube 12. A hinge channel 38 is positioned through the protrusion 36 so that the protrusion 36 is insertable between the pair of hinge tabs 32 to align the hinge channel 38 with the pair of hinge holes 34. A hinge bolt 40 is positioned through the pair of hinge holes 34 and the hinge channel 38. A hinge nut 96 is coupled to the hinge bolt 40 to fixedly position the hinge bolt 40 in the pair of hinge holes 34 and the hinge channel 38 so that the bar 14 is hingedly coupled to the tube 12.

A pair of first lock tabs 42 is coupled to and extends from a bottom 44 of the bar 14. A first hinge ball 46 is rotationally coupled to and extends between the pair of first lock tabs 42. A first bolt channel 48 is positioned through the first hinge ball 46.

A pair of second lock tabs 50 is coupled to and extends from a lower face 52 of the tube 12. A second hinge ball 54 is rotationally coupled to and extends between the pair of second lock tabs 50. A second bolt channel 56 is positioned through the second hinge ball 54 so that the second bolt channel 56 is alignable with the first bolt channel 48. A ball nut 58 is coupled to the second hinge ball 54 so that the ball nut 58 is aligned with the second bolt channel 56.

A locking bolt 60 is positioned through the first bolt channel 48 and second bolt channel 56 and is threadedly inserted into the ball nut 58 so that a head 62 of the locking bolt 60 abuts the first hinge ball 46. The head 62 of the locking bolt 60 is configured to be turned, using a socket wrench of the like, to selectively tilt the pair of rods 16 relative to the tube 12 and to fixedly position the pair of rods 16 relative to the tube 12.

A first cross channel 64 is positioned through the first hinge ball 46 so that the first cross channel 64 is perpendicular to and nonintersecting with the first bolt channel 48. A pair of first holes 66 is positioned singly in the pair of first lock tabs 42 so that the first cross channel 64 is alignable with the pair of first holes 66. A first channel bolt 68 is positioned through the pair of first holes 66 and the first cross channel 64. A first channel nut 70 is coupled to the first channel bolt 68 to fixedly position the first channel bolt 68 in the pair of first holes 66 and the first cross channel 64.

A second cross channel 72 is positioned through the second hinge ball 54 so that the second cross channel 72 is perpendicular to and nonintersecting with the second bolt channel 56. A pair of second holes 74 is positioned singly in the pair of second lock tabs 50 so that the second cross channel 72 is alignable with the pair of second holes 74. A second channel bolt 76 is positioned the pair of second holes 74 and second cross channel 72. A second channel nut 78 is coupled to the second channel bolt 76 to fixedly position the second channel bolt 76 in the pair of second holes 74 and the second cross channel 72.

The pair of rods 16 is coupled to and extends in parallel from a front face 80 of the bar 14. The rods 16 are configured to position under a vehicle component, positioning a user to utilize the engine hoist 24 to selectively lift and lower the vehicle component. Utilizing the engine hoist 24 to lift the vehicle component, rather than manually lifting the vehicle component, prevents injuries to hands and a back of the user.

The rods 16 are circularly shaped when viewed longitudinally. The rods 16 are positioned singly proximate to opposing ends 82 of the bar 14. The rods 16 are separated by from 7.6 to 27.9 centimeters. The rods 16 are separated by from 12.7 to 22.9 centimeters. The rods 16 are separated by 17.8 centimeters.

The assembly 10 also comprises a chain 84 that is coupled to the bar 14 so that the chain 84 is configured to secure the vehicle component to the bar 14. A plate 86 is coupled to and extends from the bottom 44 of the bar 14. An orifice 88 is positioned in the plate. A bolt 90 is positioned through a link 92 of the chain 84 and the orifice 88. A nut 94 is coupled to the bolt so 90 that the chain 84 is bolted to the plate 86.

In use, the tube 12 is coupled to the boom 22 by inserting the terminus 20 of the boom 22 into the first end 18 of the tube 12. The head 62 of the locking bolt 60 is turned to tilt the pair of rods 16 relative to the tube 12, as desired. The locking bolt 60 fixedly positions the pair of rods 16 relative to the tube 12. The rods 16 are positioned under the vehicle component and the engine hoist 24 is used to selectively lift and lower the vehicle component.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An engine hoist attachment assembly comprising:

a tube having a first end configured for slidably inserting a terminus of a boom of an engine hoist for removably coupling the tube to the boom;

a bar having a back face coupled to and extending bidirectionally and perpendicularly from a second end of the tube such that the bar is substantially parallel to a surface upon which the engine hoist is positioned; and a pair of rods coupled to and extending in parallel from a front face of the bar wherein the rods are configured for positioning under a vehicle component positioning a user for utilizing the engine hoist for selectively lifting and lowering the vehicle component.

2. The assembly of claim 1, further including the tube being rectangularly shaped when viewed from the first end.

3. The assembly of claim 1, further including a pair of coupling holes positioned through the tube proximate to the first end, the coupling holes being opposingly positioned on the tube wherein the pair of coupling holes is configured for aligning with a coupling channel positioned through the boom such that the pair of coupling holes and the coupling channel are configured for inserting a coupling pin for removably coupling the tube to the boom.

4. The assembly of claim 1, further including the bar being hingedly coupled to the tube such that the bar is positioned for pivoting relative to the tube while remaining perpendicular to the tube.

5. The assembly of claim 4, further comprising:

a pair of hinge tabs coupled to and extending from the back face the bar;

a pair of hinge holes, each hinge hole being positioned through a respective hinge tab;

a protrusion coupled to and extending from the second end of the tube;

a hinge channel positioned through the protrusion such that the protrusion is insertable between the pair of hinge tabs for aligning the hinge channel with the pair of hinge holes; and a hinge bolt positioned through the pair of hinge holes and the hinge channel;

a hinge nut coupled to the hinge bolt for fixedly positioning the hinge bolt in the pair of hinge holes and the hinge channel such that the bar is hingedly coupled to the tube.

6. The assembly of claim 4, further comprising:

a pair of first lock tabs coupled to and extending from a bottom of the bar;

a first hinge ball rotationally coupled to and extending between the pair of first lock tabs;

a first bolt channel positioned through the first hinge ball;

a pair of second lock tabs coupled to and extending from a lower face of the tube;

a second hinge ball rotationally coupled to and extending between the pair of second lock tabs;

a second bolt channel positioned through the second hinge ball such that the second bolt channel is alignable with the first bolt channel;

a ball nut coupled to the second hinge ball such that the ball nut is aligned with the second bolt channel; and a locking bolt positioned through the first bolt channel and second bolt channel and threadedly inserted into the ball nut such that a head of the locking bolt abuts the first hinge ball wherein the head of the locking bolt is configured for turning for selectively tilting the pair of rods relative to the tube and for fixedly positioning the pair of rods relative to the tube.

7. The assembly of claim 6, further comprising:

a first cross channel positioned through the first hinge ball such that the first cross channel is perpendicular to and nonintersecting with the first bolt channel;

a pair of first holes positioned singly in the pair of first lock tabs such that the first cross channel is alignable with the pair of first holes;

a first channel bolt positioned through the pair of first holes and the first cross channel;

a first channel nut coupled to the first channel bolt for fixedly positioning the first channel bolt in the pair of first holes and the first cross channel;

a second cross channel positioned through the second hinge ball such that the second cross channel is perpendicular to and nonintersecting with the second bolt channel;

a pair of second holes positioned singly in the pair of second lock tabs such that the second cross channel is alignable with the pair of second holes;

a second channel bolt positioned through the pair of second holes and second cross channel; and a second channel nut coupled to the second channel bolt for fixedly positioning the second channel bolt in the pair of second holes and the second cross channel.

8. The assembly of claim 1, further including the bar being substantially rectangularly box shaped.

9. The assembly of claim 1, further including the bar being tubular.

10. The assembly of claim 1, further including the rods being circularly shaped when viewed longitudinally.

11. The assembly of claim 1, further including the rods being positioned singly proximate to opposing ends of the bar.

12. The assembly of claim 1, further including the rods being separated by from 7.6 to 27.9 centimeters.

13. The assembly of claim 12, further including the rods being separated by from 12.7 to 22.9 centimeters.

14. The assembly of claim 13, further including the rods being separated by 17.8 centimeters.

15. The assembly of claim 1, further including a chain coupled to the bar wherein the chain is configured for securing the vehicle component to the bar.

16. The assembly of claim 15, further comprising:

a plate coupled to and extending from a bottom of the bar;

an orifice positioned in the plate;

a bolt positioned through a link of the chain and the orifice; and a nut coupled to the bolt such that the chain is bolted to the plate.

17. An engine hoist and engine hoist attachment assembly combination comprising:

an engine hoist comprising a boom;

a tube having a first end slidably inserted over a terminus of the boom such that the tube is removably coupled to the boom;

a bar having a back face coupled to and extending bidirectionally and perpendicularly from a second end of the tube such that the bar is substantially parallel to a surface upon which the engine hoist is positioned; and a pair of rods coupled to and extending in parallel from a front face of the bar wherein the rods are configured for positioning under a vehicle component positioning a user for utilizing the engine hoist for selectively lifting and lowering the vehicle component.

18. An engine hoist attachment assembly comprising:

a tube having a first end configured for slidably inserting a terminus of a boom of an engine hoist for removably coupling the tube to the boom, the tube being rectangularly shaped when viewed from the first end;

a pair of coupling holes positioned through the tube proximate to the first end, the coupling holes being opposingly positioned on the tube wherein the pair of coupling holes is configured for aligning with a coupling channel positioned through the boom such that the pair of coupling holes and the coupling channel are configured for inserting a coupling pin for removably coupling the tube to the boom;

a bar having a back face coupled to and extending bidirectionally and perpendicularly from a second end of the tube such that the bar is substantially parallel to a surface upon which the engine hoist is positioned, the bar being hingedly coupled to the tube such that the bar is positioned for pivoting relative to the tube while remaining perpendicular to the tube, the bar being substantially rectangularly box shaped, the bar being tubular;

a pair of hinge tabs coupled to and extending from the back face the bar;

a pair of hinge holes, each hinge hole being positioned through a respective hinge tab;

a protrusion coupled to and extending from the second end of the tube;

a hinge channel positioned through the protrusion such that the protrusion is insertable between the pair of hinge tabs for aligning the hinge channel with the pair of hinge holes;

a hinge bolt positioned through the pair of hinge holes and the hinge channel;

a hinge nut coupled to the hinge bolt for fixedly positioning the hinge bolt in the pair of hinge holes and the hinge channel such that the bar is hingedly coupled to the tube;

a pair of first lock tabs coupled to and extending from a bottom of the bar;

a first hinge ball rotationally coupled to and extending between the pair of first lock tabs;

a first bolt channel positioned through the first hinge ball;

a pair of second lock tabs coupled to and extending from a lower face of the tube;

a second hinge ball rotationally coupled to and extending between the pair of second lock tabs;

a second bolt channel positioned through the second hinge ball such that the second bolt channel is alignable with the first bolt channel;

a ball nut coupled to the second hinge ball such that the ball nut is aligned with the second bolt channel;

a locking bolt positioned through the first bolt channel and second bolt channel and threadedly inserted into the ball nut such that a head of the locking bolt abuts the first hinge ball wherein the head of the locking bolt is configured for turning for selectively tilting the pair of rods relative to the tube and for fixedly positioning the pair of rods relative to the tube;

a first cross channel positioned through the first hinge ball such that the first cross channel is perpendicular to and nonintersecting with the first bolt channel;

a pair of first holes positioned singly in the pair of first lock tabs such that the first cross channel is alignable with the pair of first holes;

a first channel bolt positioned through the pair of first holes and the first cross channel;

a first channel nut coupled to the first channel bolt for fixedly positioning the first channel bolt in the pair of first holes and the first cross channel;

a second cross channel positioned through the second hinge ball such that the second cross channel is perpendicular to and nonintersecting with the second bolt channel;

a pair of second holes positioned singly in the pair of second lock tabs such that the second cross channel is alignable with the pair of second holes;

a second channel bolt positioned through the pair of second holes and second cross channel;

a second channel nut coupled to the second channel bolt for fixedly positioning the second channel bolt in the pair of second holes and the second cross channel;

a pair of rods coupled to and extending in parallel from a front face of the bar wherein the rods are configured for positioning under a vehicle component positioning a user for utilizing the engine hoist for selectively lifting and lowering the vehicle component, the rods being circularly shaped when viewed longitudinally, the rods being positioned singly proximate to opposing ends of the bar, the rods being separated by from 7.6 to 27.9 centimeters;

a chain coupled to the bar wherein the chain is configured for securing the vehicle component to the bar;

a plate coupled to and extending from the bottom of the bar;

an orifice positioned in the plate;

a bolt positioned through a link of the chain and the orifice; and a nut coupled to the bolt such that the chain is bolted to the plate.

* * * * *